US006142127A

United States Patent [19]

Maass

[11] Patent Number: 6,142,127

[45] Date of Patent: Nov. 7, 2000

[54] RESTRICTION STRUCTURE FOR REDUCING GAS FORMATION IN A HIGH PRESSURE FUEL RETURN LINE

[75] Inventor: Martin Maass, Williamsburg, Va.

[73] Assignee: Siemens Automotive Corporation, Auburn Hills, Mich.

[21] Appl. No.: 09/236,881

[22] Filed: Jan. 25, 1999

[51] Int. Cl.[7] ..... F02M 37/04

[52] U.S. Cl. ..... 123/514

[58] Field of Search ..... 123/516, 514

[56] References Cited

U.S. PATENT DOCUMENTS

| | | | |
|---|---|---|---|
| 4,274,380 | 6/1981 | De Vulpillieres | 123/456 |
| 4,955,943 | 9/1990 | Hensel et al. | 123/73 |
| 5,285,759 | 2/1994 | Terada et al. | 123/514 |
| 5,832,900 | 11/1998 | Lorraine | 123/456 |
| 5,890,518 | 4/1999 | Fischerkeller | 123/514 |
| 6,021,759 | 2/2000 | Okajima et al. | 123/510 |
| 6,029,634 | 4/1999 | Graham | 123/514 |

FOREIGN PATENT DOCUMENTS 197 26 756 A1 7/1999 Germany ..... F02D 41/26

OTHER PUBLICATIONS

PCT International Search Report: International Application No. PCT/US99/30400, International Filing Date, Dec. 17, 1999 and Applicant, Siemens Automotive Corporation.

*Primary Examiner*—Thomas N. Moulis

[57] ABSTRACT

A fuel delivery system 10 includes a fuel rail 22 to supply fuel to at least one fuel injector 26, a high pressure fuel pump 20 to provide fuel to the fuel rail 22, a fuel regulator 28 to regulate fuel pressure at the fuel rail 22, and flow restriction structure 30, 32 disposed in a fuel return line 34 between the fuel regulator 28 and the high pressure fuel pump 20. The flow restriction structure 30, 32 is constructed and arranged to substantially prevent bubbles from reaching the high pressure fuel pump 20 when the high pressure fuel pump is providing fuel in a certain flow range to the fuel rail 22. The flow restriction structure defines at least one flow restricting orifice.

21 Claims, 8 Drawing Sheets

RESTRICTION STRUCTURE FOR REDUCING GAS FORMATION IN A HIGH PRESSURE FUEL RETURN LINE

FIELD OF THE INVENTION

This invention relates to fuel delivery systems for automobiles and more particularly to providing at least one flow restriction downstream of a fuel regulator and upstream of a high pressure fuel pump to prevent gas bubbles from reaching and damaging the fuel pump.

BACKGROUND OF THE INVENTION

When observing return flow downstream of a fuel regulator through a transparent fuel line, the Applicant has detected bubble formation. In earlier tests when the return line was connected directly to a high pressure fuel pump inlet, the pump began to fail just after 15 hours of operation. It is suspected that the pump failure was due to bubbles resulting in some kind of cavitation erosion of the pump. The Applicant had then determine that the gas bubbles consist of high volatile components of the fuel, not air or vapors. The gas bubbles can occur after the dissipative orificing process of the fuel regulator.

Accordingly, there is a need to reduce or preferably eliminate the formation of the gas bubbles in order to ensure a long life of a high pressure fuel pump.

SUMMARY OF THE INVENTION

An object of the present invention is to fulfill the need referred to above. In accordance with the principles of the present invention, this objective is obtained by providing a fuel delivery system including a fuel rail to supply fuel to at least one fuel injector, a high pressure fuel pump to provide fuel to the fuel rail, a fuel regulator to regulate fuel pressure at the fuel rail, and flow restriction structure disposed in a fuel return line between the fuel regulator and the high pressure fuel pump. The flow restriction structure is constructed and arranged to substantially prevent bubbles from reaching the high pressure fuel pump when the high pressure fuel pump is providing fuel in a certain flow range to the fuel rail. The flow restriction structure defines at least one flow restricting orifice.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The accompanying drawings, which are incorporated herein and constitute part of this specification, illustrate presently preferred embodiments of the invention, and, together with a general description given above and the detailed description of the preferred embodiments given below, serve to explain the principles of the invention.

DETAILED DESCRIPTION OF THE INVENTION

Figure 1:
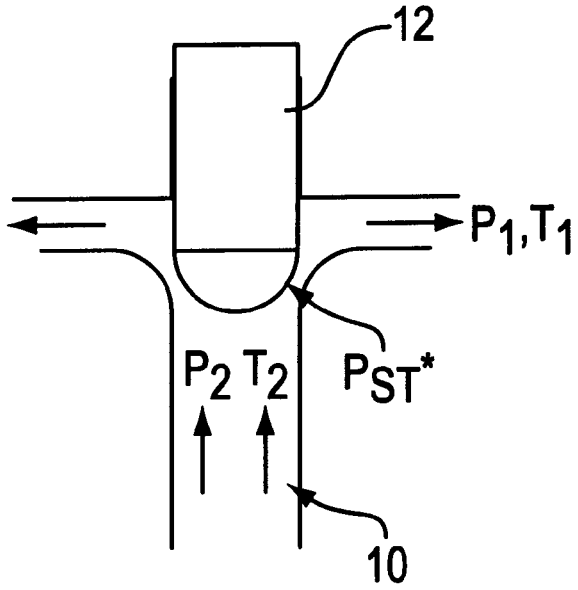
FIG. 1 (PRIOR ART)
FIG. 1 is a schematic illustration of a conventional fuel pressure regulator in a flow path.

A fuel regulator can be compared with a throttle or an orifice creating a pressure drop caused by a high dissipative process. With reference to FIG. 1, a conventional fuel rail, generally indicated at 10, is shown with a fuel regulator 12 disposed in a fluid flow path with the fluid having high-pressure and being at nearly room temperature. An inlet state is marked with a"2" in the figure. On the way to the narrowest cross-section of the orifice, the fluid becomes highly accelerated. The state at the narrowest point (i.e., at the regulator seat) is marked with as"*". After passing this point, the fluid becomes decelerated after losing much of its kinetic energy, which is an irreversible, dissipative process. The exit state is indicated by"1". The pressure at state 1 is nearly ambient (or feed pump pressure), and the temperature rises slightly in comparison to state 2 at the inlet. Under ambient conditions, the fluid would normally not form any kind of bubbles in this fuel rail system. Thus, the thermodynamic process from the inlet state 2 to the exit state 1 is responsible for gas formation in the fluid as will be explained in greater detail below.

Thermodynamically, the orificing process can be explained as follows: when considering the acceleration process from state 2 to state * under the assumption that no energy from outside is brought into the fluid (i.e., nearly adiabatic walls in the fuel rail), the acceleration entails a strong decrease in static pressure, coming from state 2, where the static pressure nearly equals the total pressure. This can be seen when applying the Bernoulli equation:

$$P_{tot}=P_{stat}+(c^2/2) \quad \text{(Equation 1)}$$

where is the density of the fluid and c is the velocity of the fluid.

At the state 2, the fluid velocity is low, thus, $P_{tot,2}$ is nearly $P_{stat,2}$. Considering the fluid flow from state 2 to state *, the assumption is isentropic flow, and can be described by:

$$P_{tot,2}=P_{tot^*,}=P_{stat^*,}+(c^{*2}/2) \quad \text{(Equation 2)}$$

because the total pressure from state 2 to state * remains nearly constant (due to the assumption that no energy is being transferred to the fluid). However, the static pressure $P_{stat,*}$ at the point labeled with * is lowest because of the high fluid velocity at this point. Only the static pressure (not the total pressure) is responsible for the issues relating to the gas bubble formation in the return line. It is known that during such deceleration of the fluid, the static pressure of the fluid becomes lower than the vapor pressure, which leads to dissolved gases in the fluid being released and then, when the pressure reaches the vapor pressure, vapor bubbles are created. The bubbles were observed to generate generally at the narrowest cross-section of the regulator and the bubbles remained stable for a few minutes in the return line.

Figure 2:
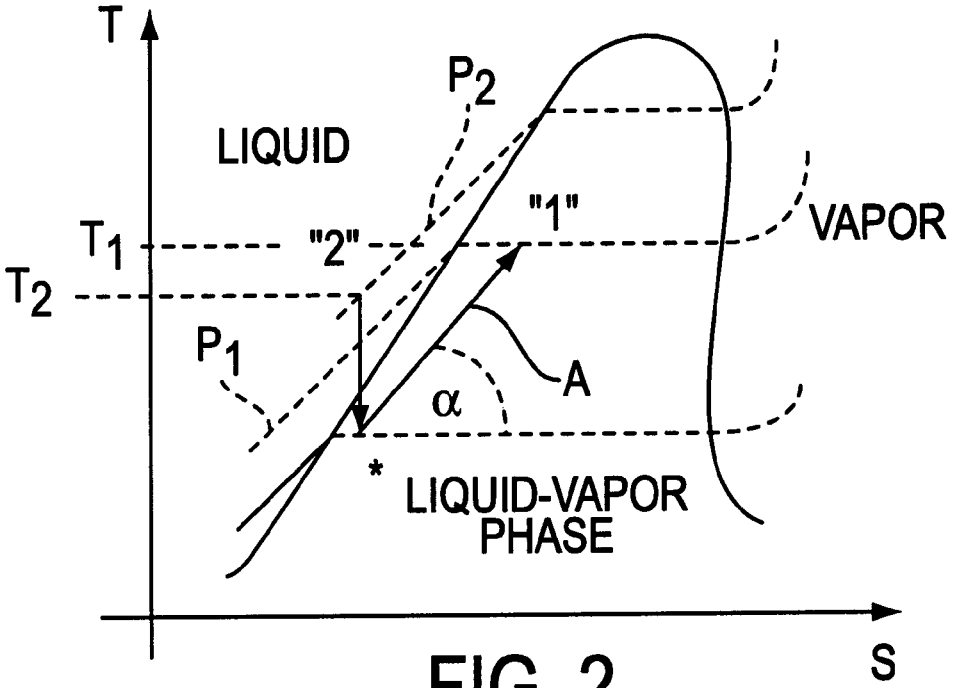
FIG. 2 (PRIOR ART)
FIG. 2 is a conventional T-S diagram of Benzol.

The thermodynamic process of this pressure regulation process can be drawn in a Temperature-Entropy (T-S) diagram to reflect the aforementioned considerations. In the diagram of FIG. 2, the behavior of Benzol (representing fuel) is schematically shown for a single phase fluid (not considering further components in the fluid such as air or other gases). Thus, with this example, the generation of vapor can be shown. The boundary curve (solid line) separates the liquid phase at the left of the diagram from the liquid-vapor phase in the middle of the diagram from the vapor phase at the right of the diagram. Additionally, the states $P_2$, $T_2$ and $P_1$, $T_1$ are shown for the isobars $P_2>P_1$ and $T_1>T_2$. Due to the acceleration of fluid at the narrowest point of the orifice, the process from state 2 to state 1 can not be directly derived by drawing a line connecting the states 2 and 1. There is first the isentropic process (without losses) from state 2 to state *, and then there is the dissipative process from state * to state 1 under high generation of entropy (losses). Then, the isobar of state * may cross the vapor-liquid region of the T-S diagram depending on the fluid velocity. The drop in temperature from state 2 to state * can be explained by using the equation of total temperature:

$$T_{tot}=T_{stat}+(c^2/2+c_p) \quad \text{(Equation 3)}$$

For liquid fluids, cp is a function of the temperature T, $c_p(T)$, and this equation is considered for a one phase fluid only. For a two phase fluid (liquid-vapor) equation 3 has to be extended with the appropriate terms for each phase. With equation 3, only the change in temperature from state 2 to state * can be determined. The increase in temperature from state * to state 1 can be derived from the known Joule-Thompson coefficient.

Once there is vapor generated, the vapor remains within the line A (state 1), depending on how much entropy is produced. In the diagram, line A is shown to be inclined at angle such that state 1 stays within the liquid-vapor zone. It can be appreciated that the line A of state 1 may point to the outside of the liquid-vapor zone, if the process is not dissipative resulting graphically in that the line A is more vertical but always <90. This also means that less entropy would have been produced. If vapor is generated and sent back to the high-pressure pump, the vapor bubble would collapse when the pressure rises in the pump. Graphically, in the T-S diagram this condition would be shown by adding another line leading to the liquid zone. This collapsing of the vapor bubbles is suspected as causing the known destructive process in the pump called cavitation erosion which may damage the pump components due to an implosion-like collapse of the vapor bubble with high frequency pressure spikes of up to approximately 2,000 bars.

The theory behind releasing dissolved air, or in general dissolved gases, is similar to the process in the T-S diagram of FIG. 2. No schematic T-S diagram is readily available for a two or more component fluid such as gasoline. Therefore, only the following descriptions can be given for such a fluid. The T-S diagram for gasoline will look more or less like that of FIG. 2. There will be a boundary curve separating a liquid zone from a liquid-gas-vapor zone and a vapor-gas zone. The process will be almost the same as described with respect to FIG. 2, with the difference being that now there is the liquid-gas-vapor zone, which represents both the amount of released gases and the amount of vapor (which have to be considered independent from each other). As explained more fully below, Applicant determined that vapor is most likely not remaining in the return line, but only released gases remain therein.

The Applicant conducted experiments using a transparent fuel regulator and fuel rail which proved that the regulator's narrowest cross-section (seat area) is responsible for gas bubbles found in the fuel return line. The Applicant noticed that the bubbles remained visible in the return line for a long period of time. Stoddard solvent was used as the fuel in the tests since it is safer than gasoline and in earlier tests, Stoddard solvent exhibited generally the same amount of bubbles in a return line as gasoline. Stoddard solvent has a much higher vapor pressure than gasoline and vapor is supposed to dissolve quickly when fluid pressure increases. Due to the longer lifetime of the bubbles, Applicant concluded that the nature of the bubbles is gas, either of air or different gases which are normally dissolved in liquid. Gas analysis performed by the Applicant later proved that the gas bubbles were caused by the higher volatile components in the fuel such as, butane, propane, etc.

The Applicant has determined that by creating a higher back pressure at the regulator seat by providing one or more flow restriction structures in the return line eliminates the gas bubbles in the return line. In addition to the variable orifice (the regulator seat), a second or more throttling process would occur downstream of the regulator's narrowest cross-section. This means that a smaller pressure drop is accomplished by the regulator, which leads to less flow velocity, and therefore to a higher static pressure in the narrowest cross-section of the regulator.

Figure 8A:
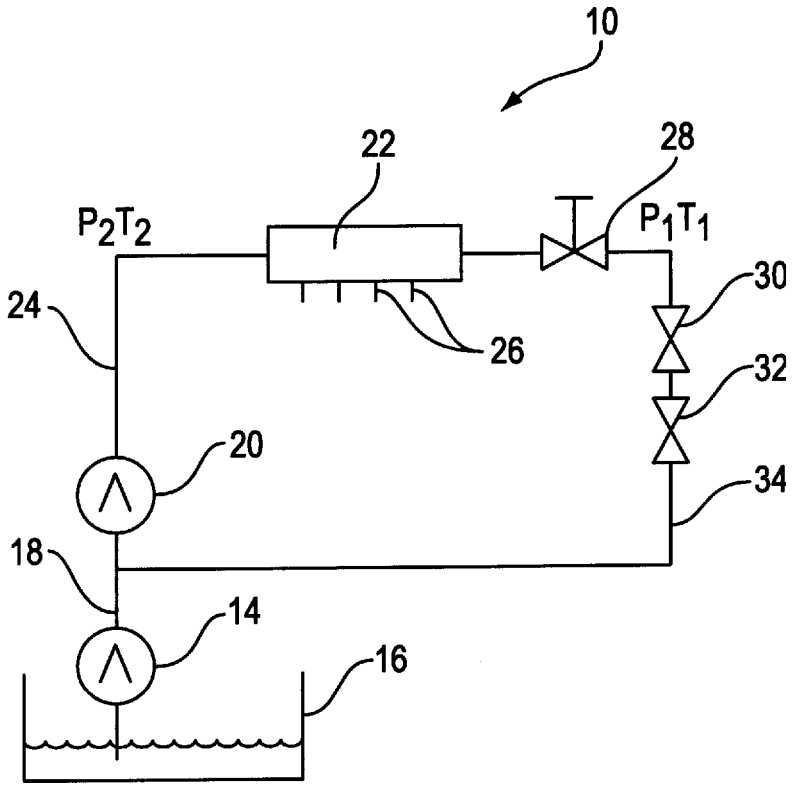
FIG. 8A is a schematic illustration, partially in section, of a fuel delivery system including flow restricting structure provided in accordance with the principles of a first embodiment of the present invention.

A first embodiment of a fuel delivery system, generally indicated at 10, provided in accordance with the invention is shown schematically in FIG. 8A. As shown, a feed pump 14 pumps fuel from a gas tank 16 via feed line 18. A high pressure fuel pump 20 is connected to feed line 18 and pumps fuel at $P_2$,$T_2$ to fuel rail 22 via connecting line 24. The fuel rail 22 supplies fuel to a plurality of fuel injectors 26. A fuel regulator 28 is provided downstream of the fuel rail 22 to regulate fuel supplied to the fuel rail 22. In accordance with the invention, first and second orifices 30 and 32, disposed in spaced relation, are provided in a return line 34 downstream of the fuel regulator 28 but upstream of the high pressure fuel pump 20. In the illustrated embodiment, although two orifices are shown, it can be appreciated that only one orifice or more than two orifices may be provided. The Applicant has determined providing two to five orifices in the return line 34 is preferable, as explained in more detail below. The orifices 30 and 32 increase the back pressure in the return line 34 under certain flow conditions. In this system 10, $P_2>>P_1$.

Figure 8B:
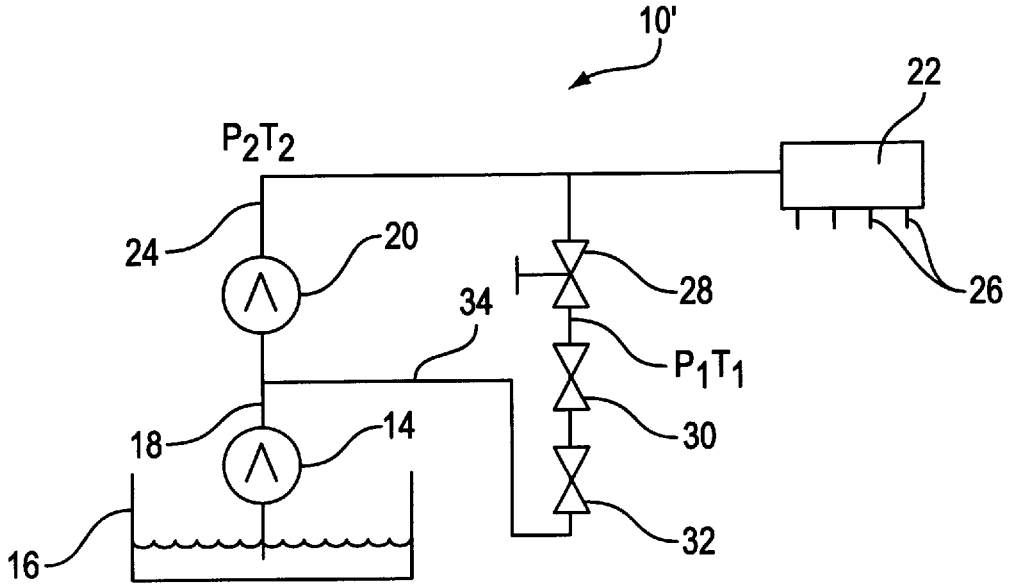
FIG. 8B is a schematic illustration, partially in section, of a fuel delivery system including flow restricting structure provided in accordance with the principles of a second embodiment of the present invention.

FIG. 8B is a schematic illustration of a second embodiment of a fuel delivery system 10' of the invention, wherein like parts are given like numbers. In this embodiment, the fuel rail 22 (dead end volume) and injectors 26 are provided upstream of the fuel regulator 28 and the orifices 30 and 32. Similar to the first embodiment, in the second embodiment, orifices 30 and 32 increase the back pressure in the return line 34 under certain flow conditions and $P_2>>P_1$.

Figure 9:
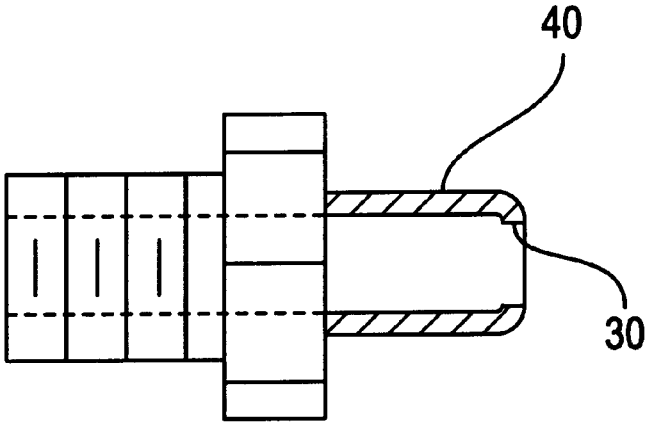
FIG. 9 is a side view of a hose fitting, shown partially in section, defining the flow restriction structure of the fuel delivery system of the invention.
Figure 10:
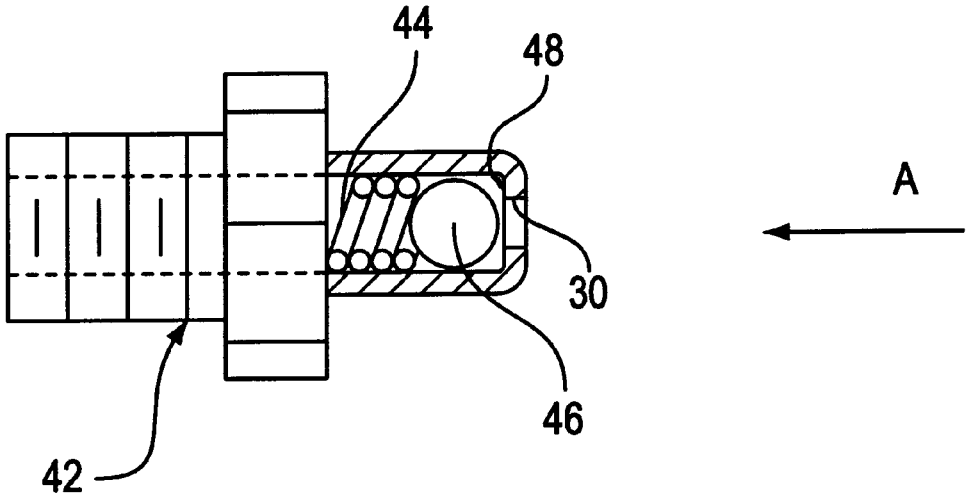
FIG. 10 is a side view, shown partially in section, of a ball valve fitting defining another embodiment of the flow restriction structure of the invention.

The orifice 30 or 32 may be provided in a variety of configurations, for example, the orifices may be defined by a hose fitting 40 as shown in FIG. 9. The hose fitting(s) can be used to connect the return line 34 between the regulator 28 and the high pressure pump 20. Another example of structure defining the orifice 30 or 32 is shown in FIG. 10. The orifice 30 or 32 may be defined by a spring actuated ball valve fitting, generally indicated at 42 in FIG. 10. The fitting 42 includes a spring 44 which normally biases a ball 46 to be seated at seat 48. The opening at seat 48 defines the orifice 30. Thus, the spring operated ball valve controls the opening and closing of the orifice 30. With the ball valve fitting 42, back pressure in the return line 34 would increase starting from zero flow in the direction of arrow A. It can be appreciated that the hose fittings 40 and ball valve fittings may be used in combination. For example, an arrangement wherein flow would occur sequentially through one or more hose fittings then through a ball valve fitting and then through one or more hose fittings is possible.

The effect of the additional orifices 18 and 20 can be derived from the Bernouli equations. In addition, the effect can be explained using thermodynamics. With Equation 2 above, it was shown that a higher velocity occurs in the state * and leads to the lowest static pressure. Considering that there are two or more flow restrictions in a cascade, the first restriction (which is the fuel regulator) does not have to throttle the pressure much because the second restriction (additional orifice) provides a throttling process down to the required pump pressure. Therefore, the regulator 14 need not close as far, since the regulator 14 only throttles a part of the required pressure drop. This means that the flow velocity and the state *does not become as high as compared to a system having no additional restriction. When designing an additional orifice, orifice size should not throttle the fluid so much that the orifice would lead to higher flow velocity and create gas bubbles. Another explanation of gas bubble elimination is that by providing the additional orifice, the back pressure behind a fuel regulator is simply too high for gas bubbles to be released.

Test results

Figure 3:
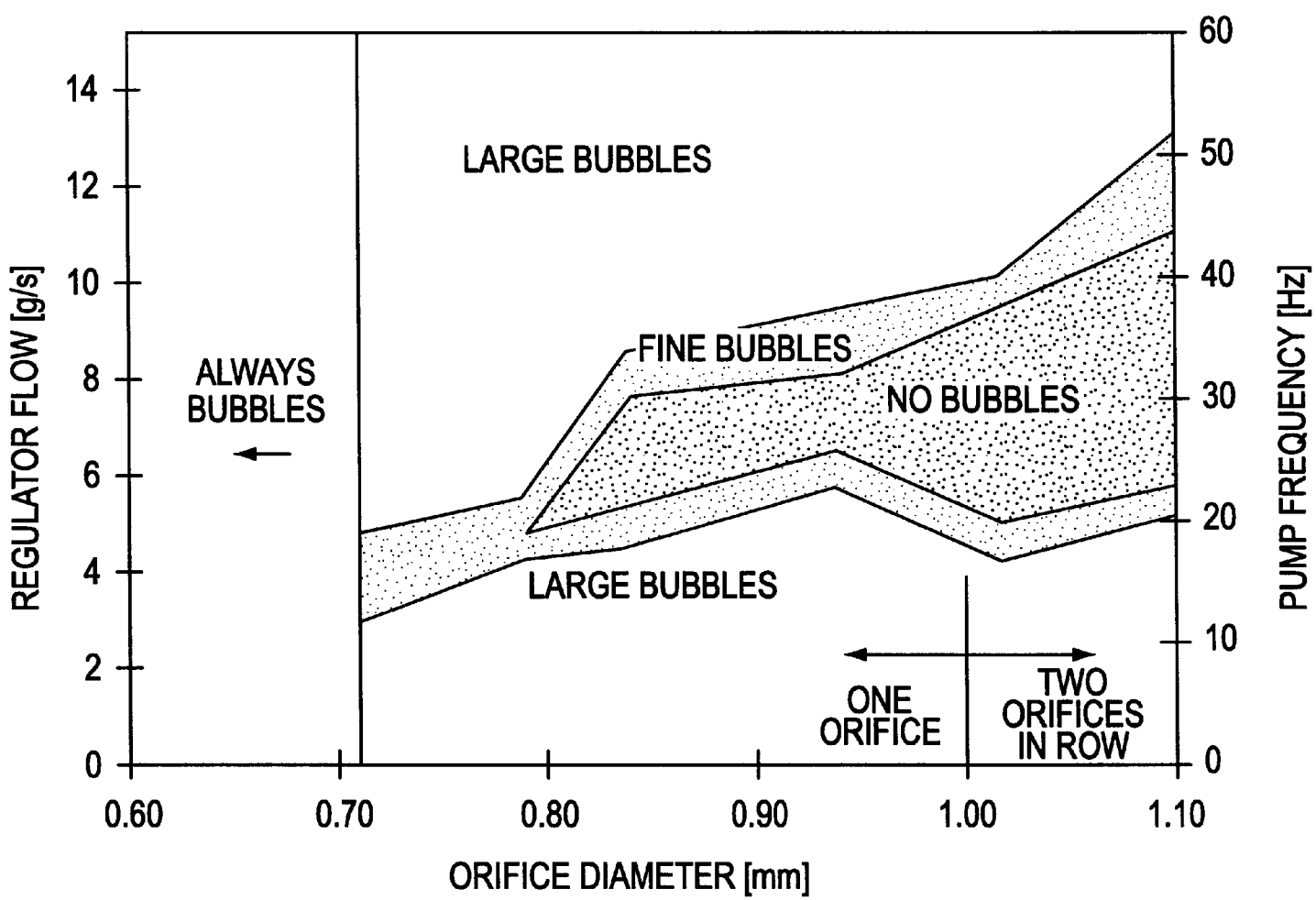
FIG. 3 is a graph of gas bubble reduction vs. regulator flow for various orifice diameters, provided in accordance with the invention.

At a flow bench using Stoddard solvent at ambient temperature, the Applicant confirmed that an additional orifice 18 located downstream of a fuel regulator 14 helps to reduce gas bubble formation. The focus of the test was to configure a test setup which did not deviate too far from an automotive application. All tests were carried out at a rail pressure of 85 bars with a return line open to ambient pressure in order to make the bubble-reducing effect more visible. The additional back pressure to feed pump pressure level (between 4 to 4.5 bar absolute pressure) helps to suppress the gas formation significantly. FIG. 3 shows for different orifice sizes (x-axis) the working range (y-axis, mass flow through the regulator), when no gas bubbles are formed at a rail pressure of 85 bars depending on the maximum and minimum flow through the fuel regulator.

In FIG. 3, the mass flow on the left side y-axis is calculated by using the pump speed, the displacement of 0.36 cc/rev, a volumetric efficiency of 90% and a density of 0.788 $dm^3$/kg for Stoddard solvent. In FIG. 3, there are three zones shown. The first, middle zone in darker gray represents the fuel flow which is free of gas bubbles. The surrounding area in lighter gray represents bubbles of smaller size, like a mist. The white area shows conditions under which larger gas bubbles are found. From left to right in FIG. 3, the orifice diameters were varied by using different precision orifices in increments of 50 m or 76 m respectively. In FIG. 3, the following tendencies are found:

There is a lower threshold of flow when gas bubbles are found. The reason for this is that the flow has to exceed a certain rate until the orifice becomes effective and suppresses the bubble formation by the regulator.

There is an upper threshold of flow when the velocity of fuel becomes critically high to entail a static pressure close to the vapor pressure in the orifice's narrowest cross-section and thus not at the narrowest point of the fuel regulator. As proven by experiments, the high back pressure created by the orifice ensures that the regulator exit flow to the inlet of the orifice is free of gas bubbles. However, the gas bubbles are formed in the orifice.

The smaller the orifice size (left side on the x-axis of FIG. 3) the lower the flow rate which is free of gas bubbles. For a given cross-section, the upper threshold of flow is achieved quickly. Thus, the working range of a small orifice is good for low flow applications.

For larger orifices, a better flow range is provided at the higher flow, but for low flow applications larger orifices are not as desirable as smaller orifices. Also, for the larger orifices, there is a limit when the fuel velocity becomes too high that gas bubbles are visible behind the orifice.

In summary, there is a lower limit of flow when a given orifice is not effective and gas bubbles from the regulator are created and pass through the orifice. There is a higher limit of flow, when gas bubbles are created due to the lowest pressure in the orifice itself. Combining the advantages of both these findings leads to a cascade of two or more orifices as shown in the right portion of FIG. 3. A two orifice cascade provides a much better working range from low to high flow than a single orifice because now the throttle in process is shared between the regulator and two orifices. Test results have shown that by providing five of more orifices in the return line for pump speed varying from engine idle to full speed, all gas bubbles were eliminated in the return line, even when the fuel was relieved to ambient pressure.

Figure 4:
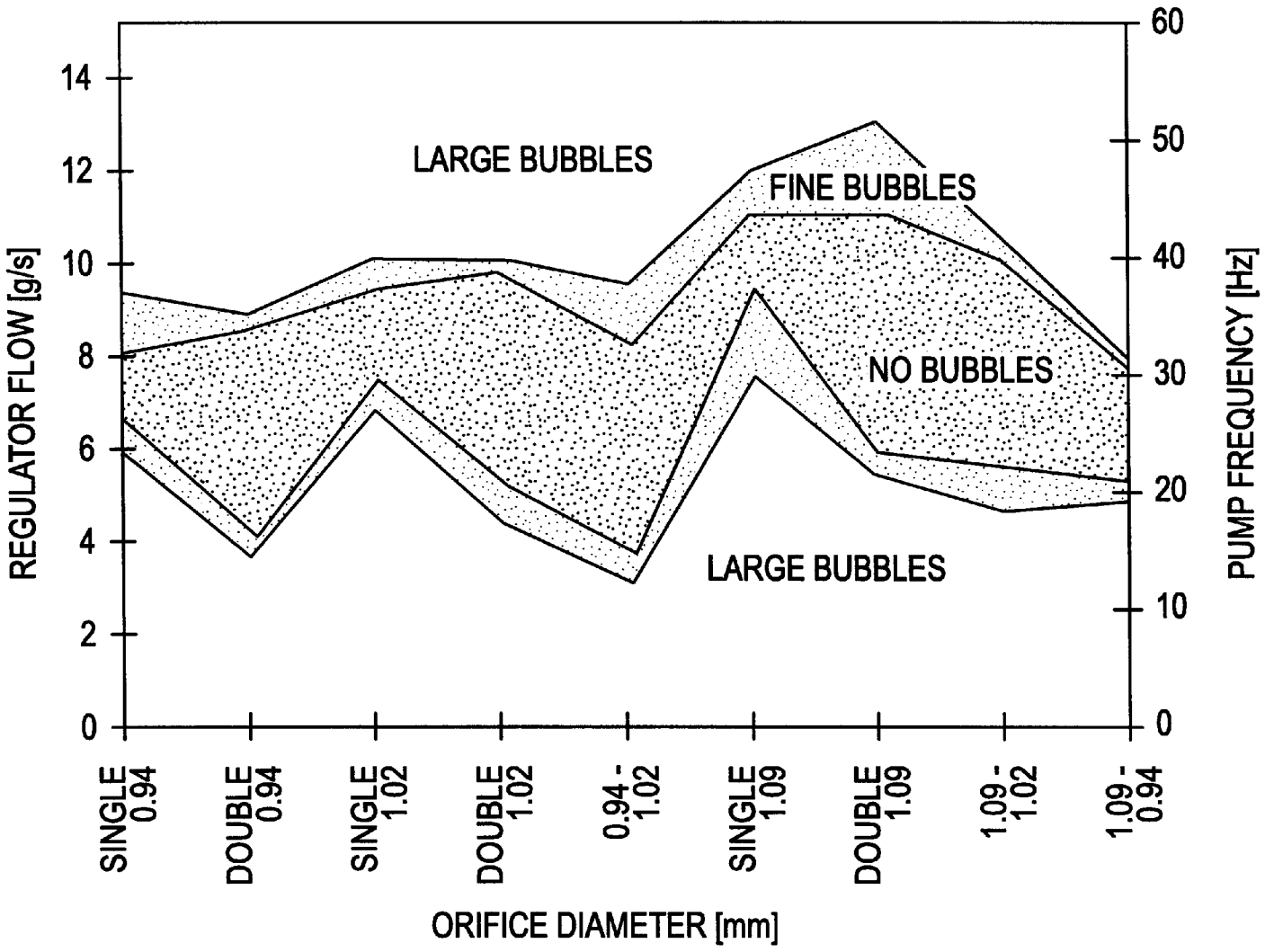
FIG. 4 is a graph of gas bubble reduction vs. regulator flow using a single orifice and a cascade of two orifices, provided in accordance with the invention.

Test results comparing different orifice sizes using a single orifice or a cascade of two orifices are shown in FIG. 4. By comparing the case of a single 0.94 mm orifice with a cascade of two 0.94 mm orifices, it is revealed that there is not much gain in working range at the higher flow threshold, but in the lower flow threshold, the area of flow free of gas bubbles is expanded significantly. The same is observed for all other applications, when using, for example, a 1.06 mm or a 1.09 mm orifice cascade.

However, when mixing different orifice sizes there is little improvement in working range. A flow path having a smaller orifice at the inlet and a larger orifice at the outlet of the cascade was also tested. Performance of this set-up was worse than a set-up having a smaller orifice behind the larger orifice. By using three or more orifices, the working range would be improved further.

It is noted that the measurement results of FIGS. 3 and 4 were taken by relieving the fluid to ambient pressure. When running returnless (i.e, returning fuel from the rail to the inlet of the high pressure pump) and applying feed pressure of 4 bar absolute to the return line with an orifice cascade applied, no bubbles at all were observed when using Stoddard solvent at a temperature of up to 40 degrees C., from very low flow up to full high-pressure pump flow(14 grams per second at more than 6500 engine rpm). Thus, when a back pressure greater than ambient pressure exists in the return line 21 containing the orifices, a wider flow range is established wherein no bubbles are formed.

Figure 5:
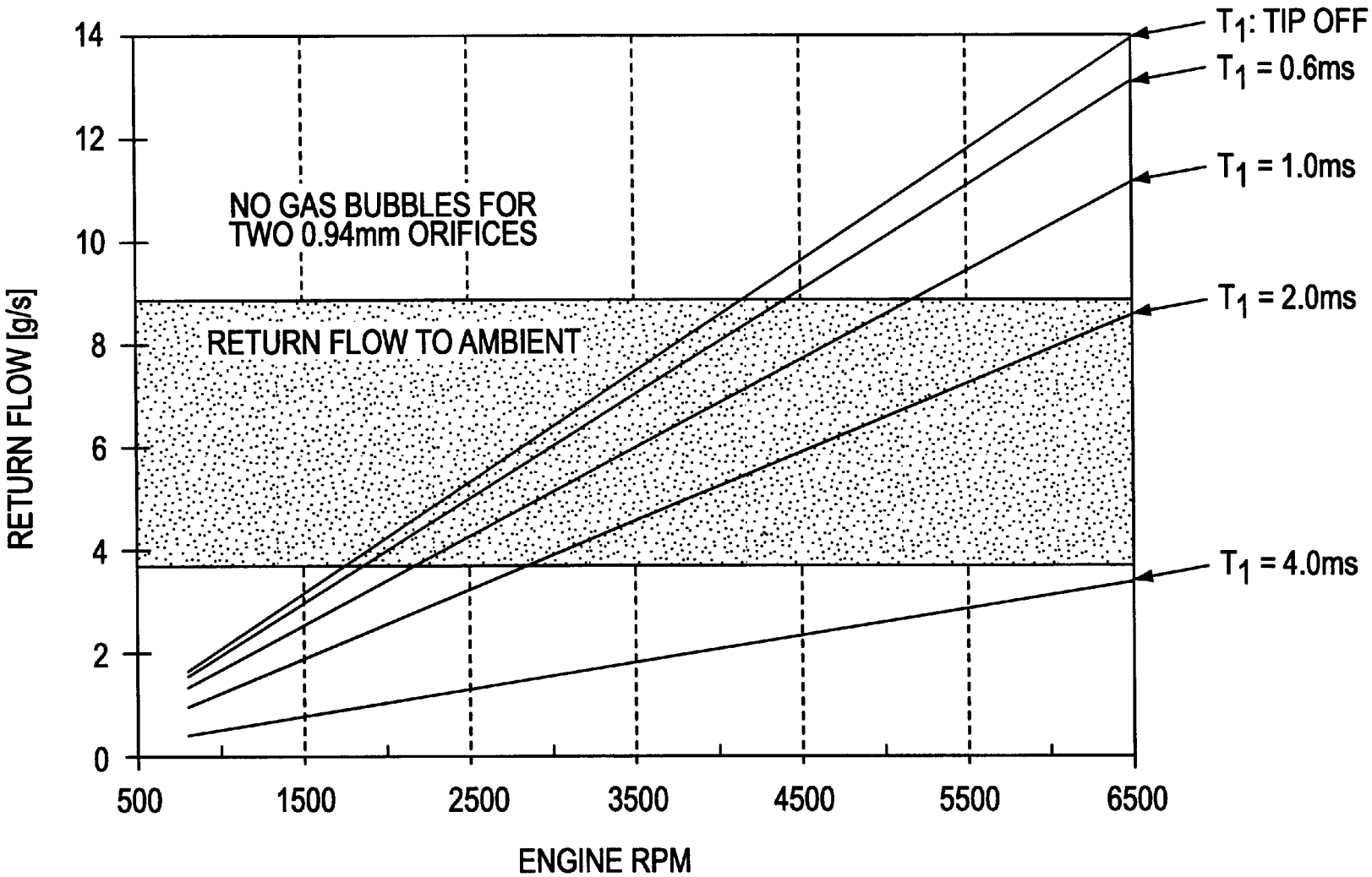
FIG. 5 is a graph of return flow vs. engine rpm with a 0.94 mm orifice cascade in accordance with the invention.
Figure 6:
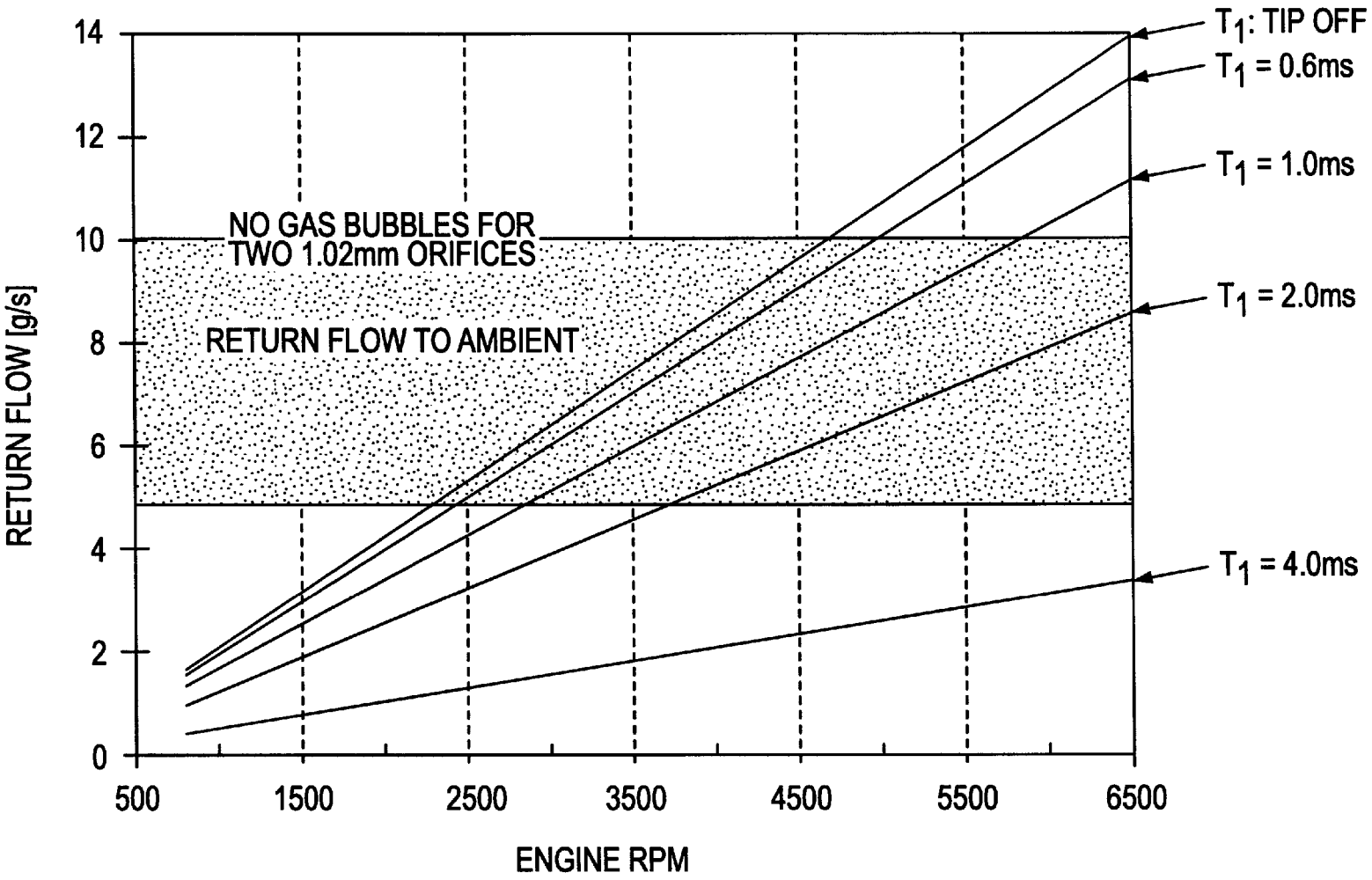
FIG. 6 is a graph of return flow vs. engine rpm with a 1.02 mm orifice cascade in accordance with the invention.
Figure 7:
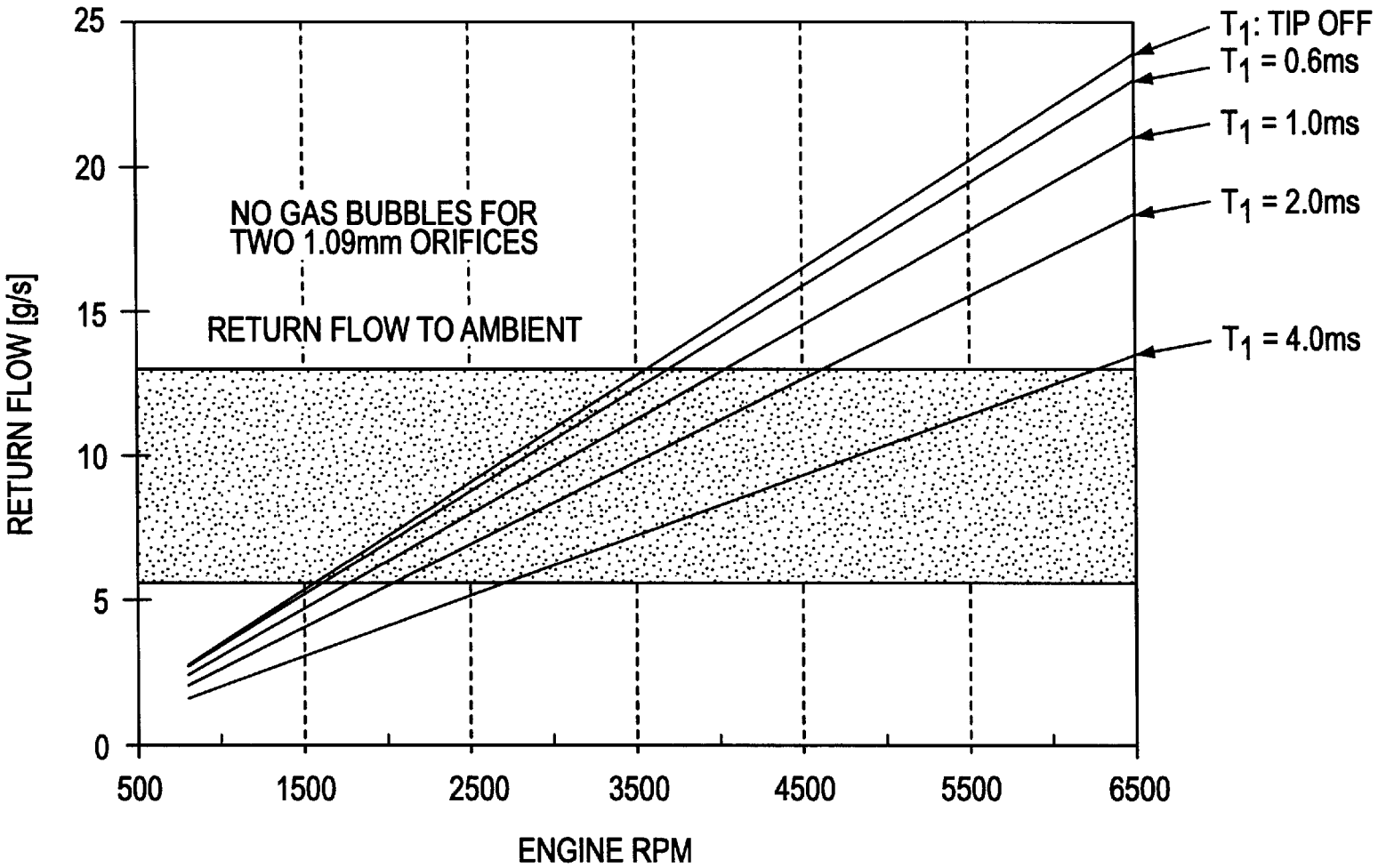
FIG. 7 is a graph of return flow vs. engine rpm with a 1.02 mm orifice cascade and a high displacement pump in accordance with the invention.

With the working range as presented in FIGS. 3 and 4, the bubble free return flow has to be evaluated under consideration of different high-pressure pump rpm and additional flow through the fuel injectors. Thus, the working flow range initiates from nearly zero flow at extreme cold startup of an automobile to the full high-pressure pump flow at high engine rpm for tip-off, which shuts-off the fuel injectors. In view of the results from FIGS. 3 or 4, the following results can be found for a pump of 0.36 cc/rev flow (with 90% volume efficiency) using two offices of 0.94 mm in cascade, as shown in FIG. 5. The high pressure fuel pump was cam shaft mounted, thus the rpm of the pump was half of the engine rpm. On the x-axis, the engine rpm (representing high pressure fuel pump mass flow) versus the return flow is plotted for different injection times. The highest flow through the fuel regulator occurs at tip-off condition, when the injectors are shut-off. The lowest flow through the fuel regulator is at the highest injection time of $T_i$=4.0 ms, assuming 48 mg/cycle. The idle mass injected is assumed to be 4 mg/cycle. For the 0.94 mm orifice cascade, the gray area of FIG. 5 represents the range where no gas bubbles are expected under the condition that the return flow is relieved to ambient. If a 1.02 mm orifice cascade is selected, then a higher flow rate would be free of gas bubbles, as shown in FIG. 6. From the point of view that the higher amount of gas bubbles is returned at high flow, which would be more risky for the high-pressure pump, it is preferable to employ a 1.02 mm orifice cascade to protect the pump. FIG. 7 shows the results of a high pressure pump with higher mass flow of 0.56 cc/rev (0.504 cc/rev effective flow with 90% vol. efficiency). Applicant has determined in testing that orifice diameters equal or larger than 0.56 mm are not able to exceed 85 bars rail pressure at full flow conditions for a fully opened fuel regulator. The proposed orifices with 1.02 mm openings are far beyond this point and cannot create back pressure of more than 30 bars at full flow of 14 grams per second.

The goal of the flow restriction structure (orifices) of the invention is to increase the back pressure in the return line 34. It can be appreciated that the back pressure in the return line may be increased by increasing the fuel feed pump pressure. This can be done with a single feed pump but with increase low pressure regulator set point. However, there are instances when it is not desired to increase the feed pump pressure due to , for example, increased costs associated with a higher quality feed pump, and the pressure rating of low pressure fuel line if existing modules are to be used. In these instances, the flow restriction structure of the invention may be used to increase the back pressure in the return line and thus prevent the formation of bubbles therein.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel delivery system comprising:

at least one fuel injector;

a high pressure fuel pump to provide fuel to the at least one fuel injector;

a fuel regulator to regulate fuel pressure at said fuel injector, and a flow restriction structure in a closed fuel line between the fuel regulator and a feed to the high pressure fuel pump constructed and arranged to substantially prevent bubbles from reaching the high pressure fuel pump when the high pressure fuel pump is providing fuel in a certain flow range to said fuel injector.

2. The system according to claim 1, wherein said flow restriction structure defines at least one flow restricting orifice.

3. The system according to claim 1, wherein said flow restriction structure defines at least two flow restricting orifices arranged in spaced relation in the return line.

4. The system according to claim 3, wherein each of said orifices has substantially the same opening size.

5. The system according to claim 4, wherein each orifice is defined in a fitting used to connect the return line between the fuel regulator and the high pressure pump.

6. The system according to claim 4, wherein each orifice is defined in a fitting used to connect the return line between the fuel regulator and the pump, said fitting including a spring actuated ball valve which controls opening and closing of the orifice.

7. The system according to claim 1, wherein the fuel is gasoline.

8. A fuel delivery system comprising:

a fuel rail to supply fuel to at least one fuel injector;

a high pressure fuel pump to provide fuel to the fuel rail;

a fuel regulator to regulate fuel pressure at said fuel rail; and a fuel restriction structure in a closed fuel line between the fuel regulator and a feed to the high pressure fuel pump constructed and arranged to substantially prevent bubbles from reaching the high pressure fuel pump when the high pressure fuel pump is providing fuel in a certain flow range to said fuel rail.

9. The system according to claim 8, wherein said flow restriction structure is provided in a flow return line connecting said fuel regulator to said high pressure fuel pump.

10. The system according to claim 9, wherein said flow restriction structure defines at least one flow restricting orifice.

11. The system according to claim 9, wherein said flow restriction structure defines at least two flow restricting orifices arranged in spaced relation.

12. The system according to claim 11, wherein each of said orifices has substantially the same opening size.

13. The system according to claim 10, wherein said orifice is defined in a fitting used to connect the return line between the fuel regulator and the high pressure pump.

14. The system according to claim 10, wherein said orifice is defined in a fitting used to connect a return line between the fuel regulator and the high pressure pump, said fitting including a spring actuated ball valve which controls opening and closing of the orifice.

15. The system according to claim 8, wherein the fuel is gasoline.

16. The system according to claim 8, further comprising a feed pump for pumping fuel form a source, said feed pump supplying said high pressure fuel pump with fuel.

17. The system according to claim 8, wherein said high pressure fuel pump and said fuel regulator ensure fuel pressure at said fuel rail to be approximately 85 bars.

18. The system according to claim 10, wherein said at least one orifice is constructed and arranged in said return line to provide a pressure in said return line of about 4 to 4.5 bars absolute pressure.

19. A method of preventing bubbles from occurring in a fuel delivery system including a fuel rail to supply fuel to at least one fuel injector, a high pressure fuel pump to provide fuel to the fuel rail, a fuel regulator to regulate fuel pressure at said fuel rail, and a closed fuel return line fluidly connecting the fuel regulator with a feed to the high pressure pump, the method comprising:

providing a flow restriction structure in the return line between the fuel regulator and the high pressure fuel pump to substantially prevent bubbles in the return line from reaching the high pressure fuel pump when the high pressure fuel pump is providing fuel to the fuel rail in a certain flow range.

20. The method according to claim 19, wherein said flow restriction structure is at least one flow restricting orifice defined in at least one fitting coupling the return line between the fuel regulator and the high pressure fuel pump.

21. The method according to claim 20, wherein said at least one fitting includes a spring actuated ball to control opening and closing of the orifice.

* * * * *